US007493920B2

(12) United States Patent
Vanderjeugt

(10) Patent No.: US 7,493,920 B2
(45) Date of Patent: Feb. 24, 2009

(54) SHED FORMING DEVICE AND WEAVING MACHINE PROVIDED WITH SUCH A SHED FORMING DEVICE

(75) Inventor: Bram Vanderjeugt, Ypres (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 11/238,126

(22) Filed: Sep. 28, 2005

(65) Prior Publication Data

US 2006/0065321 A1 Mar. 30, 2006

(30) Foreign Application Priority Data

Sep. 28, 2004 (BE) ..... 2004/0478

(51) Int. Cl.

| | |
|---|---|
| ***D03C 3/42*** | (2006.01) |
| ***D03C 3/44*** | (2006.01) |
| ***D03C 5/06*** | (2006.01) |
| *D03C 5/00* | (2006.01) |
| *D03C 13/00* | (2006.01) |

(52) U.S. Cl. ..... 139/55.1; 139/58; 139/88; 139/91

(58) Field of Classification Search ..... 139/57, 139/58, 82–88, 91, 55.1
See application file for complete search history.

(56) References Cited

U.S. PATENT DOCUMENTS

| | | | | | |
|---|---|---|---|---|---|
| 3,867,966 | A * | 2/1975 | Wieland | 139/455 |
| 3,949,788 | A * | 4/1976 | Speich | 139/57 |
| 4,391,304 | A * | 7/1983 | Taylor | 139/100 |
| 4,392,515 | A * | 7/1983 | Moessinger | 139/55.1 |
| 4,460,020 | A * | 7/1984 | Juillard | 139/82 |
| 4,802,659 | A * | 2/1989 | Hope | 267/149 |
| 4,877,060 | A * | 10/1989 | Froment et al. | 139/82 |
| 5,002,096 | A | 3/1991 | Bucher et al. | |
| 5,016,581 | A * | 5/1991 | Parsons | 123/90.25 |
| 5,195,385 | A * | 3/1993 | Johnson | 74/105 |
| 5,462,093 | A * | 10/1995 | Froment | 139/57 |
| 5,630,449 | A * | 5/1997 | Ammann et al. | 139/188 R |
| 5,666,997 | A * | 9/1997 | Vinciguerra et al. | 139/57 |
| 5,685,346 | A * | 11/1997 | Froment et al. | 139/57 |
| 5,791,381 | A * | 8/1998 | Lepka et al. | 139/68 |
| 6,079,455 | A | 6/2000 | Speich et al. | |
| 6,293,315 | B1 * | 9/2001 | Froment et al. | 139/55.1 |
| 6,863,091 | B2 * | 3/2005 | Wahhoud | 139/435.1 |
| 6,948,530 | B2 * | 9/2005 | Liue | 139/134 |
| 7,032,624 | B2 * | 4/2006 | Bruske et al. | 139/57 |

FOREIGN PATENT DOCUMENTS

| | | |
|---|---|---|
| EP | 0374279 | 6/1980 |
| EP | 0860528 | 8/1998 |
| FR | 2477186 | 4/1981 |

* cited by examiner

*Primary Examiner*—Bobby H Muromoto, Jr.
(74) *Attorney, Agent, or Firm*—James Creighton Wray

(57) ABSTRACT

A shed forming device positions warp yarns in order to form a shed in accordance with a pattern to be woven, before inserting a weft through this shed. The positioning of the warp yarns is one potential cause of an increase or a decrease of potential energy in the shed forming device. One or several elements is added to compensate, by their change of state, partly or entirely for the decrease or increase of potential energy which is produced in the shed forming device by the positioning of the warp yarns. The change of state of the elements is effectuated without any coupling with the positioning of individual warn yarns. A weaving machine uses such a shed forming device.

27 Claims, 5 Drawing Sheets

SHED FORMING DEVICE AND WEAVING MACHINE PROVIDED WITH SUCH A SHED FORMING DEVICE

This application claims the benefit of Belgian Application No. 2004/0478 filed Sep. 28, 2004, which is hereby incorporated by reference in its entirety.

BACKGROUND OF THE INVENTION

On the one hand, the invention relates to a shed forming device, comprising means provided to position warp yarns in order to form a shed in accordance with a pattern to be woven before inserting a weft through this shed, the positioning of the warp yarns being the possible cause of an increase or a decrease of potential energy in the shed forming device. On the other hand, the invention relates to a weaving machine provided with such a shed forming device.

In shed forming devices according to the state-of-the-art, potential energy is built up on the basis of warp yarn tension, this potential energy being possibly additionally supplied with the potential energy of spring systems serving to bring the warp yarns back in a specific position. In accordance with the pattern to be woven, the warp yarns are moved, individually or as a group from one position to another position, whereby the warp yarn tension and/or the tension of the springs will be varied. Each time, this leads to a modified situation of the potential energy, which, in case of an excess, will be lost in the form of heat, and which, in case of want, has to be supplemented by supplying energy through the driving device. Forming the weaving pattern required may cause strong variations in the supply of energy by the driving device. Supply or removal of energy has to be performed during each machine cycle. Therefore, in case of strong variations it may occur that each machine cycle will need a strong variation of the energy supply. The operational speeds of such machines may amount to a 1000 cycles per minute or more.

Driving systems of, among others, weaving machines, Jacquard machines and Jacquard weaving machines are not the right systems to supply such short variations of the energy supply, without causing an irregular behavior of the driving device which, in turn, means an irregular load on the components of the driving device and a variable operational speed. This can be the possible cause of an irregular quality of the fabrics produced or may even cause machine parts to be broken in the cinematic chain of the weaving machines or Jacquard machines.

Until recently, in flat Jacquard weaving, the quality of the most frequent fabric structures was that the number of warp yarns going up and the number of warp yarns going down, most of the time, were almost the same. In this manner the variation in potential energy occurring, was limited and therefore the load on the Jacquard drive was practically a constant one. With new weave structures this is not always the case any longer and a growing number of variations has come up, giving cause to an irregular demand of energy supply and an irregular progress of the speed.

When weaving face-to-face carpets, where the non-active pile warp yarns (the dead pile warp yarns) are woven into the backing fabric, it sometimes happens that the dead pile warp yarns are sequentially selected, parting from the outside of the inner shot to the inside of the outer shot, where in quite a number of weaves, these position changes will occur synchronically between the upper and the lower fabric, in other words, the dead pile is moving up simultaneously and moving down simultaneously, both in the upper and in the lower fabric. This will cause an unbalanced building up of potential energy, resulting in an irregular load of the Jacquard machine as a function of the time.

These effects likewise occur with other shed forming devices, such as selvedge systems and shaft machines.

With selvedge systems, the number of warp yarns involved is smaller, but the drive of the selvedge system is lighter in the same proportion. Finally, the effect of an irregularly varying potential energy is as problematic as with Jacquard machines.

With shaft machines, each selection element drives a shaft that is moving a set of warp yarns. Here also, the number of shafts is limited, nevertheless the influence of the variation of potential energy is considerable because of the large number of warp yarns, the potential energy of which is changing per motion of a shaft. With a fabric structure in which the number of shafts moving up is different from the number of shafts moving down, the fluctuations in potential energy are considerable and the result is an operation because of which the weaving machine will function at an uncontrolled variable speed. In EP 0 860 528 a solution is proposed to render variable the spring force of the retracting springs that is caused by the various positions taken up by the warp yarns. Because the heddles and warp yarns are drawn downwards under a constant pressure by means of a cylinder, the force exerted on the heddles and on the warp yarns remains practically constant, consequently the Jacquard device will no longer have to compensate multiples of the retracting force as the Jacquard machine will attain more positions. Moreover, the retracting force can be made adjustable in a simple way, according to the invention, especially by adapting the operating pressure of the device.

However, a disadvantage of this device is that the effect will not present a solution for an unbalanced load of a Jacquard device, as may occur, for instance, because of the dead pile warp yarns that are moving synchronically in the upper and lower fabric.

In EP 0 374 279 a solution is proposed to reduce the heavy load on hooks, for instance when the installation is operating with repeats, and therefore the hook will have to absorb many times the force of the retracting spring. By using springs operating above the point where the repeats are disconnected, the increased load on the hooks is partly compensated. By installing the springs to be movable, the spring force can be adjusted as a function of the fabric or as a function of the repeat changing.

Nor is this possibility to compensate proposing any possibility whatsoever to compensate the irregular load caused by the pattern of the weave, as all the hooks are compensated in the same way independently of the load caused by the pattern.

In EP 0 529 025 a preferred embodiment is described in which a spring is provided that is connected to a tackle element in order to reduce the resulting force required by the retracting spring. Here also, an effect is realized by which the load on the retracting springs is reduced so that the dimensions of the retracting springs can be reduced, or a longer life span can be obtained. Neither will this solution enable to compensate the irregularities of the load, as a function of the pattern.

In U.S. Pat. No. 5,462,093 a system is described for damping the oscillating motion of a weaving machine by means of providing tension or compression springs, in order to obtain a state of equilibrium.

The disadvantage of such an adjustment is that it only proposes a solution within a certain speed range and it requires special provisions to be able to supply additional energy when starting and at low speeds. Neither will this damping enable a compensation for the unbalance linked to the pattern.

SUMMARY OF THE INVENTION

Therefore the purpose of the invention is to provide a shed forming device in accordance with the preamble of the first claim and to provide a weaving machine with a shed forming device where the irregular load of the drive of the shed forming device will be partly or completely compensated by decreasing or increasing the potential energy in the shed forming device.

On the one hand, this purpose is solved by providing a shed forming device, which comprises means provided to position warp yarns in order to form a shed in accordance with a pattern to be woven, before inserting a weft through this shed, the positioning of the warp yarns causing the potential energy in the shed forming device to be increased or decreased, but adding one or more elements to the shed forming device partly or completely compensating the increase or decrease of the potential energy occurring in the situation of the shed forming device before the said elements have been added, and the said elements being incorporated in the shed forming device in such a manner, that the increase or the decrease of the potential energy by the said elements will occur independently of the positioning of the warp yarns.

This has the advantage that, without these additional elements contributing to the positioning of the warp yarns in accordance with the pattern to be woven, these elements will partly or entirely compensate the irregular load in the drive of the shed forming device. Therefore, these elements have no influence on the static effect of the forces on the warp yarns. Moreover, because the elements are able to limit the variations in potential energy, the energy to be supplied will be kept practically constant, and the load on the components of the shed forming device will occur much more regularly.

In a first preferred embodiment according to the invention, the said additional elements are springs which are connected to one or more components moving up and down.

Preferably, the one or more components moving up and down to which the springs are connected, will contribute to the normal operation of the shed forming device.

In a preferred embodiment of a shed forming device according to the invention, the springs in the shed forming device are rigidly connected to the one or more components moving up and down.

In case the shed forming device is a Jacquard machine, preferably the one or more springs are rigidly connected to a rocking lever of the Jacquard machine.

On the other hand, in case the shed forming device is a Jacquard machine, the springs may be rigidly connected to a knife grid of the Jacquard machine.

In case the shed forming device is a shaft machine, the springs may be rigidly connected to one or more weaving frames of the shaft machine.

In another preferred embodiment of the invention, at their extremities which are not connected to the one or more components of the shed forming device moving up and down, the springs are connected to one or more additional elements moving up and down.

Preferably, the one or more additional elements moving up and down are movable up and down across different positions, in order to adjust a specific spring force in the springs to keep the resulting potential energy in the shed forming device as constant as possible.

This has the advantage that the force exerted on the machine element moving up and down can be adjusted, so that it will be possible to shift from one pattern to be woven to another pattern, on condition that the spring force will be readjusted.

The additional elements movable up and down, may be moved up and down manually in order to obtain a readjustment of the spring force, or an electric, electro-mechanical, electro-pneumatic or electro-hydraulic actuator may be installed in the shed forming device, by means of which the one or more additional elements movable up and down may be adjusted.

Controlling the electric, electro-mechanical, electro-pneumatic or electro-hydraulic actuator may be done by instructions entered from a control screen or from a program on the machine control device.

In this manner, it will be possible to check in the machine operating control whether the spring force is corresponding to the compensation required for the pattern to be woven that has been chosen. If this should not be the case, the machine may be stopped or it will be made impossible to start the machine and this deviation may be announced on the machine or on the machine operating control. In doing so, an additional load may be avoided that might occur, due to an unbalance in the energy supply required, because of an incorrect adjustment or negligence, when changing the weaving pattern of the machine. In this manner, a possible machinery breakdown, excessive or irregular wear of the machine and poor quality of the fabric may be avoided.

In a Jacquard machine as a shed forming device, preferably additional harness cords are used, which on one side are connected to the said springs and which on the other side are connected to hooks which may be selected by the Jacquard machine, the increase or the decrease of the potential energy being compensated by selecting the said hooks.

Preferably, a tackle is provided to connect a said harness cord to two hooks, in order to be able to bring each spring in each position at each weft.

In a shaft machine as a shed forming device, preferably one or several additional shafts are provided, to which the said springs are connected.

On the other hand, a cross member may be provided to which the said springs are connected in case a shaft machine is used as a shed forming device.

When using a shaft machine as a shed forming device, another possibility is that a direct connection between one or several levers to the said springs is provided.

In case the shed forming device is a Jacquard machine, part of or all the said springs have a spring constant that is a multiple of the spring constant of the retracting springs which are connected to the harness cords that are responsible for the positioning of the warp yarns.

On the other hand, in this situation, part of or all the said springs may be strong springs having connected to one or several of the additional elements or devices provided to move the said springs over a specific height.

An additional extension or reduction of these springs with respect to the normal selection motion of the shed forming device will increase or decrease the effect of the spring on the total potential energy.

Preferably, in that case, the drive of the said additional elements or devices may be of an electric, electro-mechanical, electro-hydraulic or electro-pneumatic nature. In this manner, the resulting potential energy may be compensated with non-repetitive patterns.

In case the shed forming device is a shaft machine, one or more additional shafts may be provided which are connected to one or several of the said springs, which are controlled up and down in height with relation to the shaft by a separate device, in order to take up positions leading to a building-up or run-down of potential energy as a function of the variations in the load on the shaft machine as a function of the weaving pattern.

In a Jacquard machine used as a shed forming device, preferably one or several heavy springs or weights are used, which will be selected by selectors in order to move whether or not together with a set of special adapted or additional knives.

When the shed forming device is a shaft machine one or several heavy springs or weights are used, which are selected by selectors to be connected whether or not to a weaving frame of the shaft machine.

In this manner it is possible to program a rough compensation of the increase or decrease in potential energy, created by the unbalance in the drive of the shed forming device, as a function of the pattern to be woven together with the programming of the pattern. From the processing of the forming of the pattern it is possible to calculate the magnitude of the unbalance at each weft of a weft yarn and it will be possible to determine which springs or weights should be selected in order to compensate the effect.

In another preferred shed forming device according to the invention, the said additional elements are actuators capable of compensating any unbalance in the resulting potential energy.

On the other hand, the purpose of the invention is attained by providing a weaving machine comprising a shed forming device according to the invention as described above.

In the following detailed description of a number of embodiments of a shed forming device according to the invention, the following characteristics and advantages of the invention will be further clarified. The intention of this description is only to clarify the general principles of the present invention, and therefore no part of this description may be interpreted as a restriction of the field of application of the invention or of the patent rights demanded for in the claims.

In this description, by means of reference numbers, reference is made to the two FIGS. 1 through 5, which have been attached at the present and which, in a schematic way, are representing a number of various embodiments of a number of examples of a shed forming device according to the invention in which:

DETAILED DESCRIPTION OF THE PREFERRED EMBODIMENTS

A shed forming device according to the invention comprises means provided to position warp yarns to form a shed in accordance with a pattern to be woven, before inserting a weft through this shed. Because of the positioning of the warp yarns an increase or a decrease of potential energy may occur, because of which an irregular load on the drive of the shed forming device is produced, as already described above. In order to solve this problem one or several elements are joined to the shed forming device which, partly or entirely, are compensating the decrease or increase of the potential energy caused in the situation of the shed forming device before adding the said elements to the shed forming device. Moreover, the said elements are incorporated in the shed forming device in such a manner that the increase or decrease of potential energy will occur by the said elements independently of the positioning of the warp yarns. Therefore the elements, which are added to the shed forming device, can have a similar operation as the elements ensuring the positioning of the warp yarns in accordance with the pattern to be woven, but the operation of these additional elements has no influence on the positioning of the warp yarns. Therefore, these elements are not moving any warp yarns in forming the shed.

The additional elements may be springs (1;9), which are connected to one or several components moving up and down.

When the weaving pattern is repetitive, springs (1) with special adapted dimensions are rigidly connected to one or several components moving up and down in order to build up a potential energy during the weaving process ensuring that the total potential energy in the shed forming device will undergo minor variations.

Figure 1:
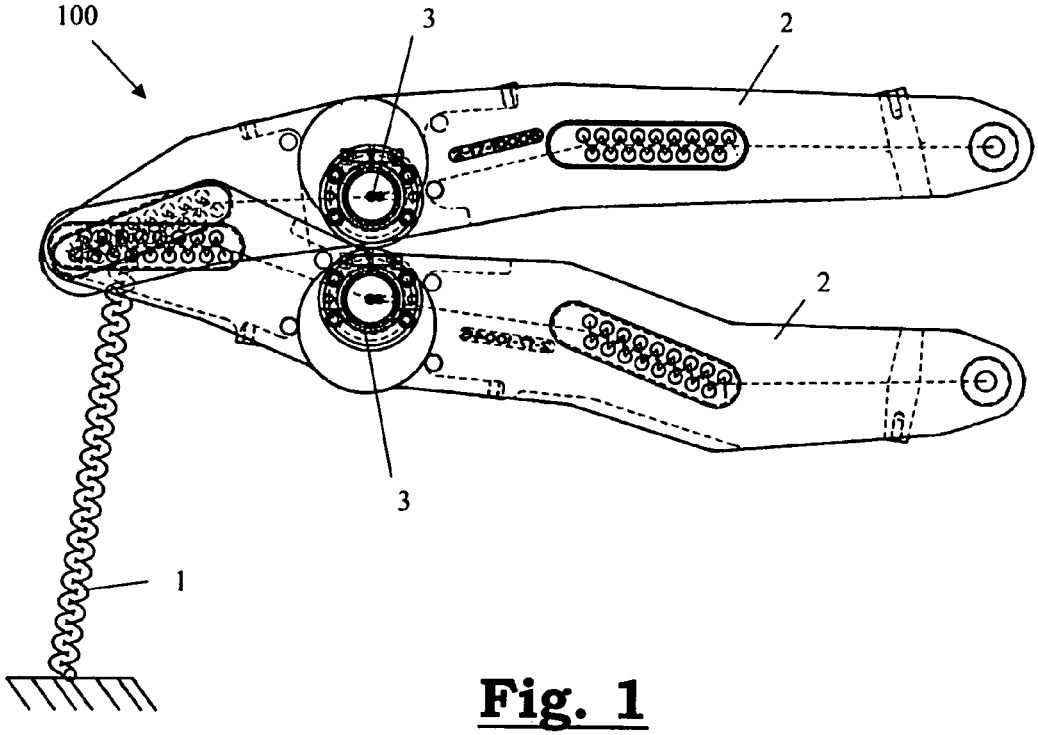
FIG. 1 is representing a Jacquard machine in an embodiment according to the invention in which the additional element is a spring that has been connected to a rocking lever moving up and down and, at its other extremity, is connected to the Jacquard machine.

In FIG. 1, part of a Jacquard machine (100) is represented in which a fixed spring (1) is connected to a rocking lever (2) of the Jacquard machine. The rocking lever (2) will transform its rocking motion around its shaft (3) into an up and down motion of one or several knife grids, each comprising a set of knives, provided to take along whether or not, hooks being selected by actuators, during their up and down motion.

The springs (1) added to the Jacquard machine, which are dimensioned in accordance with the load on the Jacquard machine and with the pattern to be woven, may likewise be connected to a knife grid (4) in the Jacquard machine. In a shaft machine, the additional springs (1) may be connected to one or several weaving frames of a shaft drive.

Figure 2:
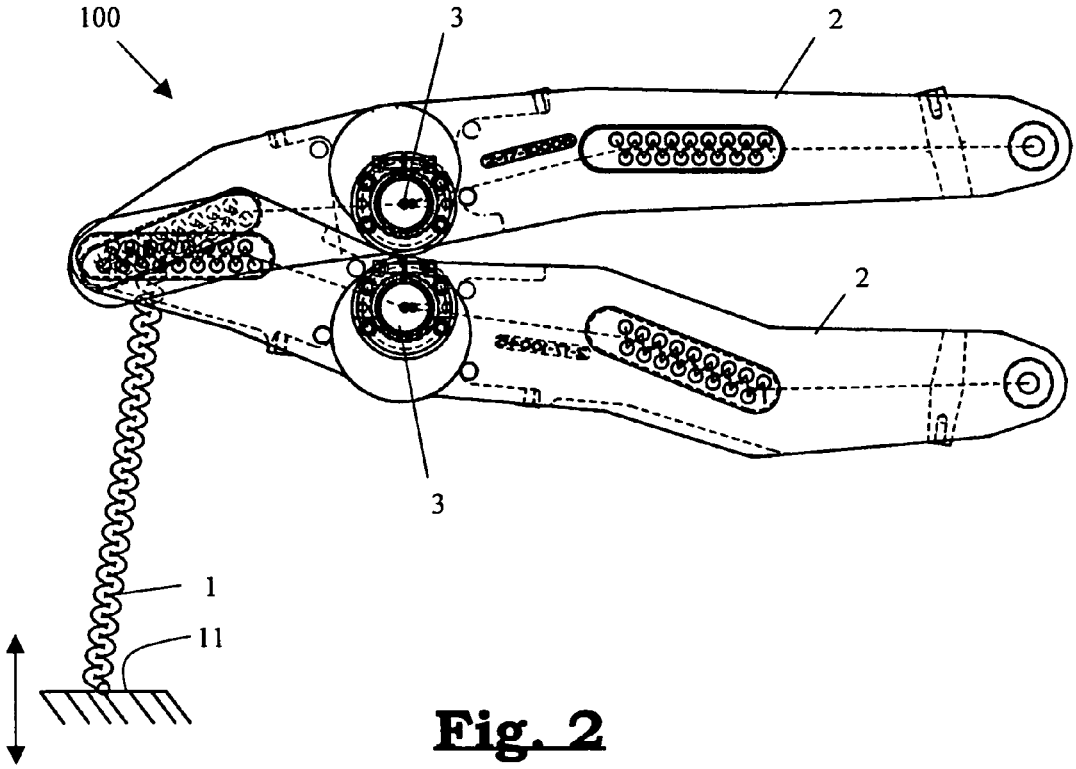
FIG. 2 is representing a device similar to the one represented in FIG. 1 with the difference that the lower end of the spring is connected to an additional element that is movable up and down.

As represented in FIG. 2, the extremity of the springs for a repetitive pattern not connected to the component moving up and down may be connected to one or several additional elements (11), which may be moved up and down. Preferably, this up and down motion may occur over various positions, in order to adjust a specific spring force in the springs to keep the resulting potential energy in the shed forming device as constant as possible. In this manner, the force being exerted on the element moving up and down may be easily adjusted, so that it will be possible to change from one pattern to be woven to another pattern, simply by adjusting the spring force. Adjusting may be done in a mechanical, a hydraulic, a pneumatic or an electric way.

The new adjustment of the spring force in the springs may occur by manually moving up and down the elements which are movable up and down, or an electric, electro-mechanical, electro-pneumatic or electro-hydraulic actuator may be installed by means of which the one or several additional elements moving up and down can be adjusted. Controlling this actuator may occur by means of instructions entered from a control screen or from a program on the control device of the machine. From the control screen, the value required is adjusted and the correction will be carried out by the actuator.

Because the spring force of the spring (9) can be adjusted, the variable compensating power of the spring may be determined from the pattern to be woven and be processed into a control signal by the processor of the control, driving the actuator in order to adjust the spring to have the required spring force in each machine cycle.

Controlling the machine may also occur by means of a device to measure the situation of the spring. This measuring of the situation may be, for instance, a measuring of the position of the movable extremity that is not connected to the component moving up and down. This will allow to check in the machine control whether the spring force of the springs is corresponding to the compensation in potential energy that is required for the pattern to be woven that has been chosen. If this should not be the case, the weaving machine may be stopped or starting may be prevented and this deviation may be displayed on the weaving machine. Thus, by an incorrect adjustment or negligence, when passing from one pattern to be woven to another, any additional load on the drive of the shed forming device, causing an unbalance in the energy supply required, will be avoided. In this manner any machinery breakdown, excessive wear or any irregular operation of the weaving machine will be avoided.

Figure 3:
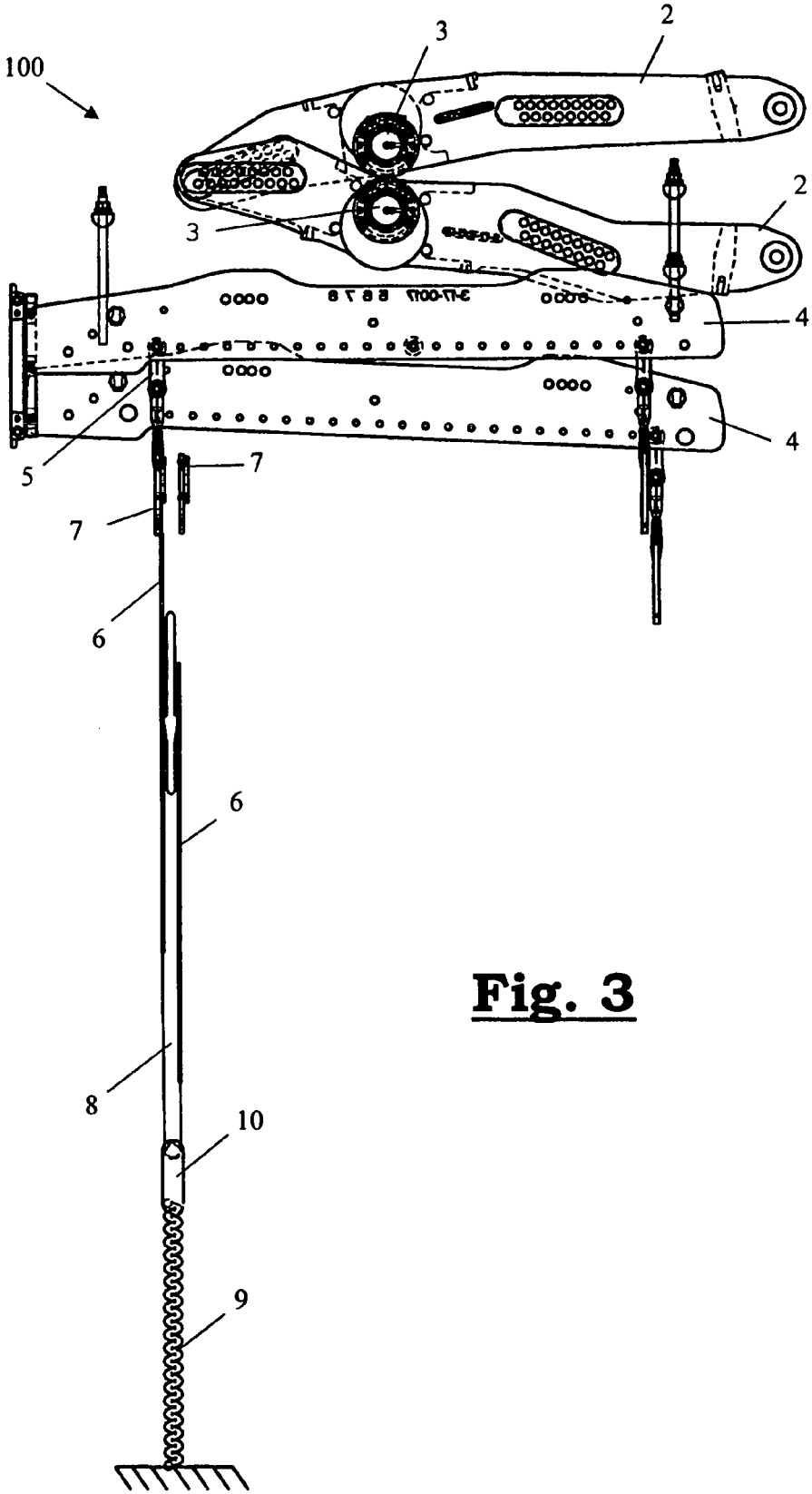
FIG. 3 is representing a side view of a Jacquard machine according to the invention in which the spring is connected to a tackle around which a harness cord is moving, which is connected to hooks, which may be selected to be connected whether or not to knives that are moving up and down.
Figure 4:
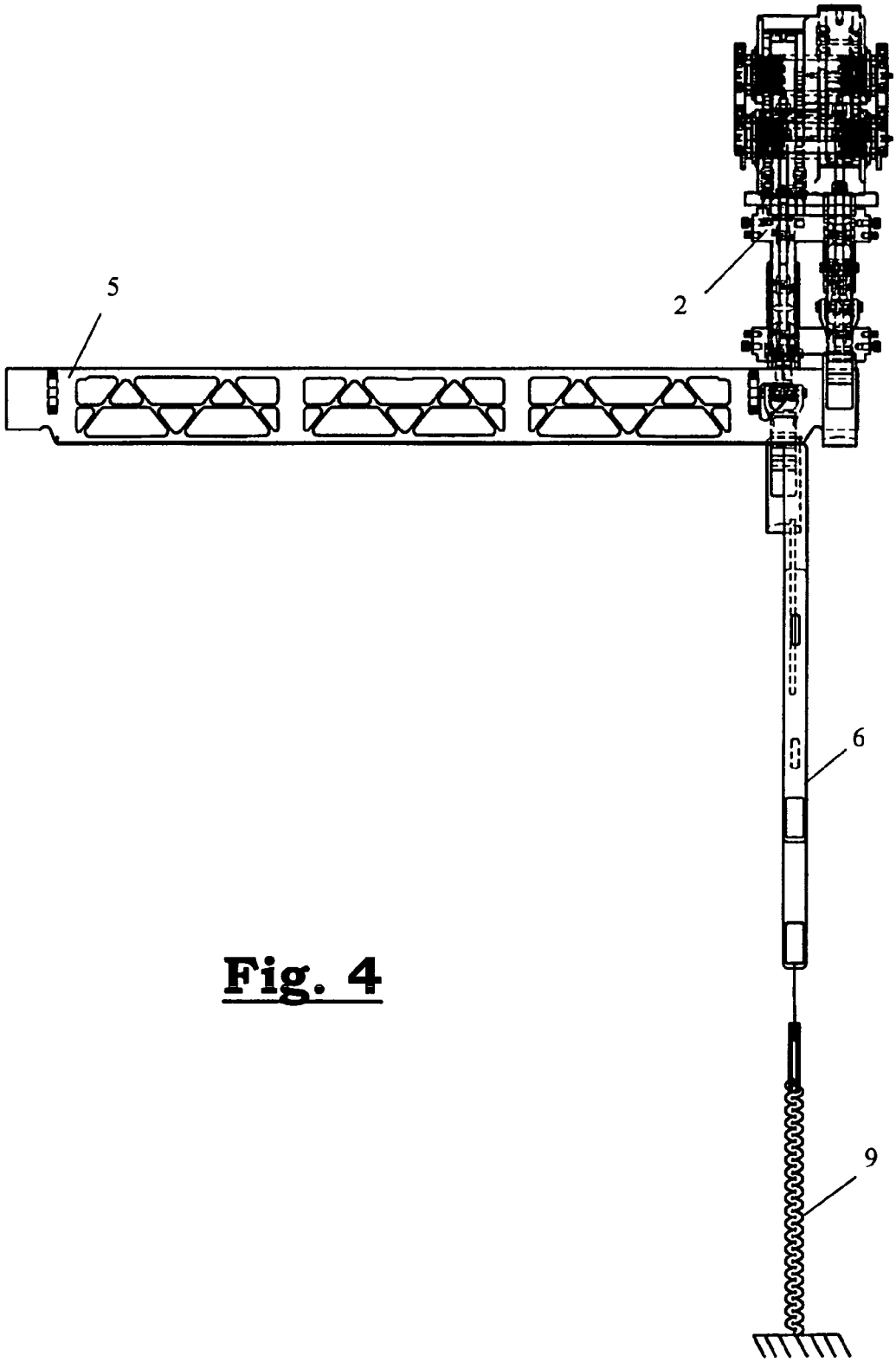
FIG. 4 is representing a front view of an embodiment as represented in FIG. 3.

In case the pattern to be woven is a non-repetitive one, as represented in the FIGS. 3 and 4, additional harness cords (8) may be used in a Jacquard machine used as a shed forming device, which, on one side, are connected to springs (9) and which, on the other side, are connected to hooks (6) that may be selected by the Jacquard machine. These hooks (6) are selected such that any variation in potential energy will be compensated. For instance, when in a two position Jacquard machine 50 warp yarns more are moving up than there are moving down, then, when 50 additional harness cords are used that are connected to springs (9) and that are situated in the upper position, these yarns can be selected in order to be moved down. The basic principle is, that a number of springs are available that are able to move down in opposition with the net number of warp yarns that are moving in a specific direction. In order to be able to bring each spring at each weft into each position, a tackle (10) may be provided to connect a harness cord (8) to two hooks (6).

As far as the springs (9) are concerned that are connected to the additional harness cords (8), other springs may be selected than the retracting springs that are connected to the harness cords (8) responsible for the positioning of the warp yarns. The additional springs (9) may have a spring constant that is a multiple of the spring constant of the springs that are responsible for the positioning of the warp yarns. For instance, when in the case mentioned above to that effect a spring is used that is 5 times more rigid, it will be enough to select only 10 harness cords (8) to compensate the unbalance with respect to the 50 additional warp yarns.

In case the shed forming device is a shaft machine, this may be realized, for instance, by providing a number of additional shafts, which are not connected to warp yarns, but to which additional springs are connected. Such shafts may also be reduced, for instance, to one cross member, or even to a direct connection of one or several levers to the additional compensating spring.

Figure 5:
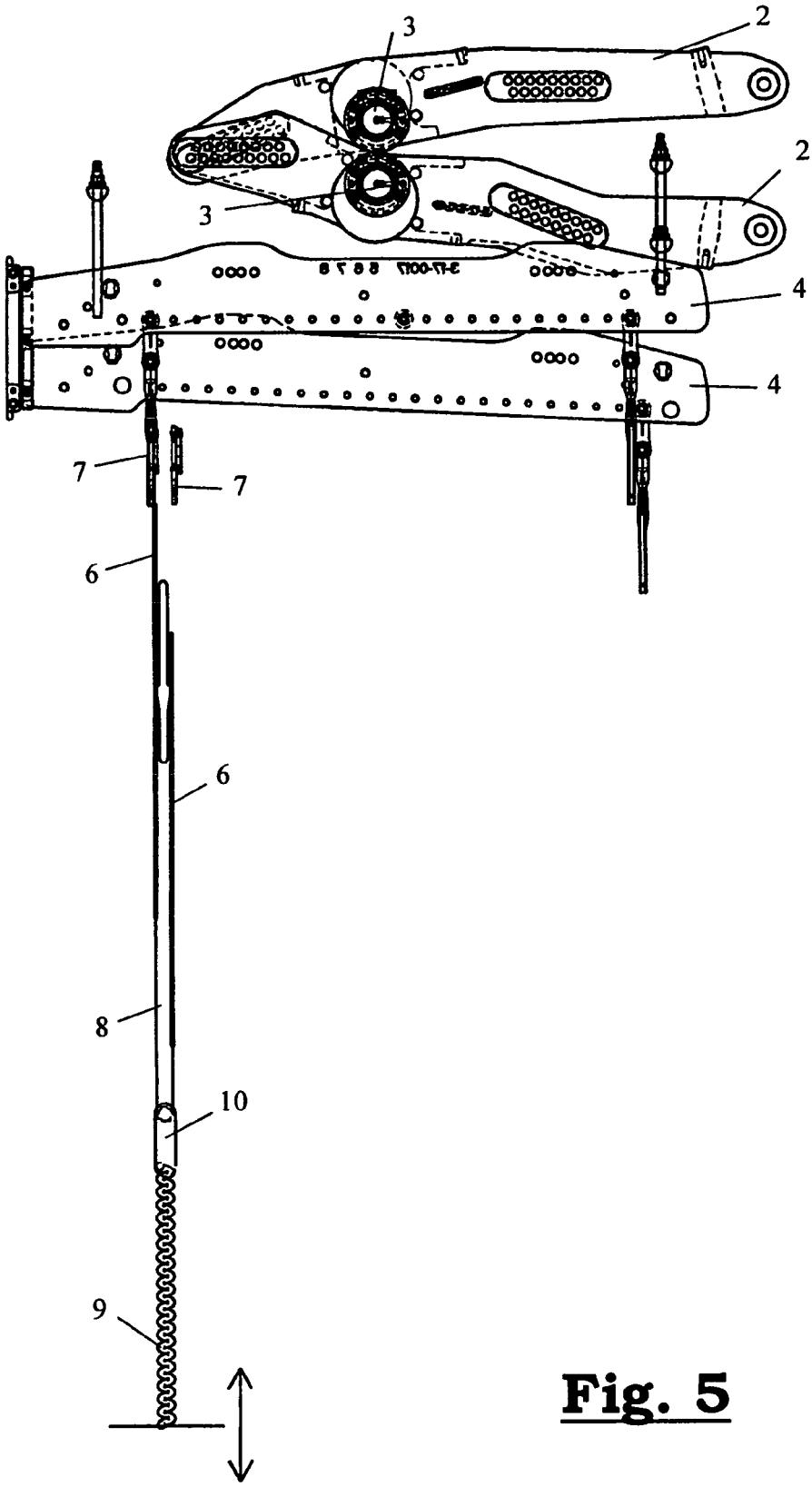
FIG. 5 is representing a side view of a device similar to the one represented in FIG. 3 with the difference that the other extremity of the spring is connected to an additional element moving up and down.

The effect of the higher value of spring constant for the additional springs (9) may also be realized by connecting all or part of the springs (9) to the additional compensating harness cords (8) to one or several devices to move those springs (9) over a specific height, as represented in FIG. 5. An additional elongation or reduction of the spring with respect to the normal selection motion of the shed forming device, will increase or decrease the effect of that spring on the potential energy. The drive of this device may be of an electric, electro-mechanical, electro-hydraulic or electro-pneumatic nature.

Herewith, it will be possible, using a shaft machine as a shed forming device, to compensate the load variations by making use of only one additional shaft being connected to one or several springs, which is operated with respect to the shaft by a separate device in order to take up positions that will lead to build up or to reduce the potential energy as a function of the variation in load exerted on the shaft machine subject to the pattern to be woven.

Furthermore the choice may be made to use a limited number of heavy springs or weights that are selected by suitable selectors, in order to move whether or not together with a set of suitable or additional knives in the Jacquard machine or to be connected whether or not to a weaving frame of the shaft machine. In this manner, it will be possible to program a rough compensation for the unbalance of the shed forming device, together with the programming of the pattern to be woven.

However, the embodiments of a shed forming device according to the invention as used with a non-repetitive pattern to be woven, may also be used with a repetitive pattern to be woven.

Furthermore, the additional elements may be actuators as well.

A solution even more accomplished exists in that adjusting the actuator during the process will be extended within the cycle of the weaving machine and/or the Jacquard machine, so that, for instance, the variable load in consequence of the reading-in margin will be compensated. Nevertheless, because of the reading-in margin, non-selected hooks will be taken along by the knife at the end of a cycle, and as such, they will exert a force on the knife grid, which is situated in the upper position. Likewise, when starting a new cycle, for a short wile, selected hooks will rest on the downward moving knife in the downward moving knife grid along the distance of the reading-in margin. A fine control of the actuators, moving up and down a set of compensating springs, will cause the actuators to supply this energy at the right moment.

The invention claimed is:

1. Shed forming method, comprising providing means to position warp yarns in order to form a shed in accordance with a pattern to be woven before inserting a weft through this shed, providing one or several compensating elements, directly attaching each of the one or several compensating elements to one or more components of the means to position the warp yarns, other than a warp yarn guiding means, compensating for an energy imbalance created by positioning the warp yarns where more warp yarns are going in one vertical direction than in another by applying forces to the one or more components with the one or several compensating elements, the applied forces exerting a net upward influence when the greater number of warp yarns are moving downwards and exerting a net downward influence when the greater number of warp yarns are moving upwards.

2. Shed forming method according to claim 1, wherein the one or several compensating elements are compensating springs.

3. Shed forming method according to claim 2, wherein the one or more components of the means to position the warp yams, to which the compensating springs are connected, contribute to the normal operation of a shed forming device.

4. Shed forming method according to claim 3, wherein the directly attaching one or several compensating elements to one or more components of the means to position the warp yarns comprises rigidly connecting the compensating springs to the one or more components of the means to position the warp yarns.

5. Shed forming method according to claim 4, wherein the shed forming device is a Jacquard machine, in which the one or more components of the means to position the warp yarns comprise a rocking lever of the Jacquard machine.

6. Shed forming method according to claim 4, wherein the shed forming device is a Jacquard machine, in which the one or more components of the means to position the warp yarns comprise a knife grid of the Jacquard machine.

7. Shed forming method according to claim 4, wherein the shed forming device is a shaft machine, in which the one or more components of the means to position the warp yarns comprise one or more weaving frames of the shaft machine.

8. Shed forming method according to claim 3, further comprising connecting the compensating springs, at their extremities which are not connected to the one or more components of the means to position the warp yarns, to one or more adjustment elements.

9. Shed forming method according to claim 8, wherein the one or more adjustment elements are movable up and down across different positions in order to adjust a specific spring force in the compensating springs, to keep the resulting potential energy in the shed forming device as constant as possible.

10. Shed forming method according to claim 9, further comprising moving the adjustment elements up and down manually in order to obtain a new adjustment of the spring force.

11. Shed forming method according to claim 9, wherein an electric, electro-mechanical, electro-pneumatic or electro-hydraulic actuator is incorporated in the shed forming device by means of which the one or several adjustment elements may be adjusted.

12. Shed forming method according to claim 11, further comprising controlling the electric, electro-mechanical, electro-pneumatic or electro-hydraulic actuator by entering instructions from a control screen or from a program on a machine control device.

13. Shed forming method according to claim 12, further comprising providing the machine control device with means to measure the situation of the compensating springs.

14. Shed forming method according to claim 2, wherein the shed forming device is a Jacquard machine, further comprising using additional harness cords in the Jacquard machine and connecting them on one side to the said compensating springs and on the other side to hooks that may be selected by the Jacquard machine, and wherein compensating for an energy imbalance created by positioning the warp yams comprises the selection of the said hooks.

15. Shed forming method according to claim 14, further comprising using a tackle to connect a harness cord to two hooks in order to be able to bring each compensating spring into each position at each weft.

16. Shed forming method according to claim 2, wherein the shed forming device is a shaft machine, in which one or several additional shafts is provided, in which the one or more components of the means to position the warp yarns comprise the one or several additional shafts.

17. Shed forming method according to claim 2, wherein the shed forming device is a shaft machine, and a cross member is provided, in which the one or more components of the means to position the warp yams comprise the cross member.

18. Shed forming method according to claim 2, characterized wherein the shed forming device is a shaft machine, further comprising directly connecting one or several levers to the said compensating springs.

19. Shed forming method according to claim 14, further comprising connecting retracting springs to the harness cords that are responsible for the positioning of the warp yarns, wherein part of or all the compensating springs making up the one or several compensating elements have a spring constant that is a multiple of the spring constant of the retracting springs connected to the harness cords that are responsible for positioning of the warp yarns.

20. Shed forming method according to claim 14, further comprising connecting part of or all said compensating springs to one or several adjustment elements that may be moved across one or several positions.

21. Shed forming method according to claim 20, wherein the drive of the adjustment elements is of an electric, electro-mechanical, electro-hydraulic or electro-pneumatic nature.

22. Shed forming method according to claim 16, further comprising connecting one or several of said compensating springs to one or several adjustment elements, in order to cause the compensating springs to take up positions leading to an increase or a decrease of potential energy as a function of the varying load of the shaft machine as a function of the pattern to be woven.

23. Shed forming method according to claim 2, wherein the shed forming device is a Jacquard machine, in which the compensating springs comprise one or several strong springs, further comprising selecting the one or several strong springs in order to move them with a set of specially adapted knives.

24. Shed forming method according to claim 1, wherein the shed forming device is a Jacquard machine, in which the one or several compensating elements comprise one or several weights, further comprising selecting the one or several weights by selectors in order to move them with a set of special adapted knives.

25. Shed forming method according to claim 2, wherein the shed forming device is a shaft machine, in which the compensating springs comprise one or several strong springs, further comprising selecting the one or several strong springs by selectors in order to connect them to a weaving frame of the shaft machine.

26. Shed forming method according to claim 1, wherein the shed forming device is a shaft machine, in which the one or several compensating elements comprise one or several weights, further comprising selecting the one or several weights by selectors in order to connect them to a weaving frame of the shaft machine.

27. Shed forming method according to claim 1, wherein the one or several compensating elements are actuators.

* * * * *